166-307 SR
6/28/77 XR 4,032,193

United States Patent [19]

Drinkard et al.

[11] 4,032,193

[45] June 28, 1977

[54] COAL DISAGGREGATION BY BASIC AQUEOUS SOLUTION FOR SLURRY RECOVERY

[75] Inventors: Gary Drinkard; Michael Prats; Stephen Michael O'Brien, all of Houston, Tex.

[73] Assignee: Shell Oil Company, Houston, Tex.

[22] Filed: Mar. 28, 1974

[21] Appl. No.: 455,695

[52] U.S. Cl. ..... 299/4; 44/1 B; 166/307; 175/64; 241/1

[51] Int. Cl.[2] ..... E21C 41/02

[58] Field of Search ..... 299/4, 5, 2; 241/1; 208/8; 44/1 B, 51; 175/64; 166/307; 48/DIG. 6, 210

[56] References Cited

UNITED STATES PATENTS

| | | | |
|---|---|---|---|
| 1,532,826 | 4/1925 | Lessing | 299/5 |
| 2,788,956 | 4/1957 | Pevere et al. | 166/259 |
| 3,472,553 | 10/1969 | Miller | 299/5 |
| 3,815,826 | 6/1974 | Aldrich et al. | 241/1 |

OTHER PUBLICATIONS

"Solvent Power for Coals at Room Temp.", by I.G.C. Dryden Chemistry and Industry, June 7, 1952, pp. 502–508.

*Primary Examiner*—Ernest R. Purser

[57] ABSTRACT

This invention is a process for treating an underground formation of coal by contacting the coal with a basic aqueous solution for a time sufficient to disintegrate at least a portion of the coal formation. Subsequently, at least some of the disintegrated material is removed to create permeability in the coal formation. The coal is then treated with a heat carrying fluid to recover energy values from the coal. Another aspect of this invention is a process for slurry mining coal which comprises contacting the coal with the basic aqueous solution for a time sufficient to disintegrate the coal and form a slurry, then conveying said slurry to a receiving terminal.

11 Claims, 3 Drawing Figures

COAL DISAGGREGATION BY BASIC AQUEOUS SOLUTION FOR SLURRY RECOVERY

BACKGROUND OF THE INVENTION

1. Field of the Invention

This invention relates to a process for slurry mining coal and a process for treating a coal bed, which has been made permeable, with a heat-carrying fluid to recover energy values from an underground coal formation.

2. Prior Art

It is generally known that coal is removed from the ground using two methods, either strip mining, in which the coal is merely dug out of the ground by mechanical or hydraulic means and transferred to the place of use, or underground mining using methods such as slurry mining (see U.S. Pat. No. 3,260,548 to Reichl), room and pillar, or longwall. The means for taking the coal out of the ground in the room and pillar or longwall methods are generally mechanical cutters, rippers, planers, loaders, etc. In slurry mining hydraulic apparatus is used to direct pressurized water at the coal seam to disaggregate the coal and form a slurry which is then pumped out of the mine to the surface. In all of these coal mining techniques it is first necessary to loosen the coal from the formation using some means such as explosives, hydraulic pressure, or physically contacting the coal with cutters, etc., before the coal can be transported away from the mine and to the place of use. Such methods require much time and large capital outlays for expensive loosening equipment.

Attempts have been made in the coal industry to find an agent which would attack the coal in such a way that the bonds between the coal constituents would be weakened and mechanical separation of the caol could be facilitated. Such a process is taught by U.S. Pat. No. 1,532,826 to Lessing, wherein the coal is treated with an acid or an aryl amine to facilitate mechanical segregation of the coal. Although such an acid treatment facilitates disaggregation by mechanical means the treatment does not result in complete disaggregation of the coal as does an acid treatment in phosphate mining as described in U.S. Pat. No. 3,359,037 to Every and Hughes.

In the past, attempts have been made to treat coal by various methods in order to recover, either in situ or after the coal had been removed from the mine, liquid or gaseous fuels therefrom. Because of the costs involved in first removing the coal from the ground it would be preferred to carry out the treatment for recovery of fuels from the coals in situ. Generally such in situ attempts have not been very successful because, i.a., the coal seam is generally impermeable to the recovery fluids injected into the formation and thus the coal present in the formation cannot be sufficiently contacted by the fluid to obtain an adequate recovery. U.S. Pat. No. 2,595,979 to Pevere and Arnold teaches a method of liquidification of coal wherein the underground coal is first contacted with hydrogen at about 550° F or more and 1000 pounds per square inch pressure. The residue remaining can then be treated with an oxygen containing gas to gasify the residue. However, the process is slow because the gases do not contact much of the coal surface area at any one time.

It has now been discovered that by contacting a coal formation with a basic aqueous solution, particularly sodium hydroxide, the coal can be substantially disintegrated. Although it has been generally known that the finely ground bituminous coal can be treated with an aqueous alkali solution at elevated temperatures to obtain a coke-like residue, and that the hydrogenation of these residues forms products which are more hydrocarbon-like in nature than does a similar hydrogenation of the coal itself, (see for example "Action of Aqueous Alkali on a Bituminous Coal" by Leo Kasehagen in *Industrial and Engineering Chemistry*, May, 1937), it was surprising indeed to discover that the coal substantially disintegrates when treated with a basic aqueous solution. This phenomena can be utilized to disintegrate a coal formation so that coal can be mechanically removed more easily or removed by slurry mining. Further, if sufficient porosity is maintained in an underground cavity to permit subsequent fluid injection, reactions by these fluids can be used to recover further chemical or energy values from the coal.

SUMMARY OF THE INVENTION

Broadly, this invention is a process for treating subterranean coal which comprises contacting said coal with a basic aqueous solution, preferably sodium hydroxide, for a time sufficient to disintegrate the coal. This invention can also be used to treat subterranean coal bed which outcrop from the surface of the earth. It will be appreciated that, when the process of this invention is used to recover coal from an underground formation, it is preferred to first penetrate the coal bed with at least one borehole, then pump the basic aqueous solution down the borehole to contact the underground seam of coal. Either mechanical enlargement of the wellbore in the vicinity of alkali injection or removal of some of the initially disaggregated coal is necessary to provide adequate porosity.

The basic aqueous solution is maintained in contact with the coal for a time sufficient to substantially disaggregate said coal. The coal thus disaggregated can then be transported to a receiving terminal, preferably above ground, either by mechanical means or by a slurry.

In another aspect of this invention, after the basic aqueous solution has been maintained in contact with the coal for a period of time sufficient to disintegrate the coal, it is contacted with a heat carrying fluid to recover chemical or energy values from the coal.

DETAILED DESCRIPTION OF THE INVENTION

Figure 1:
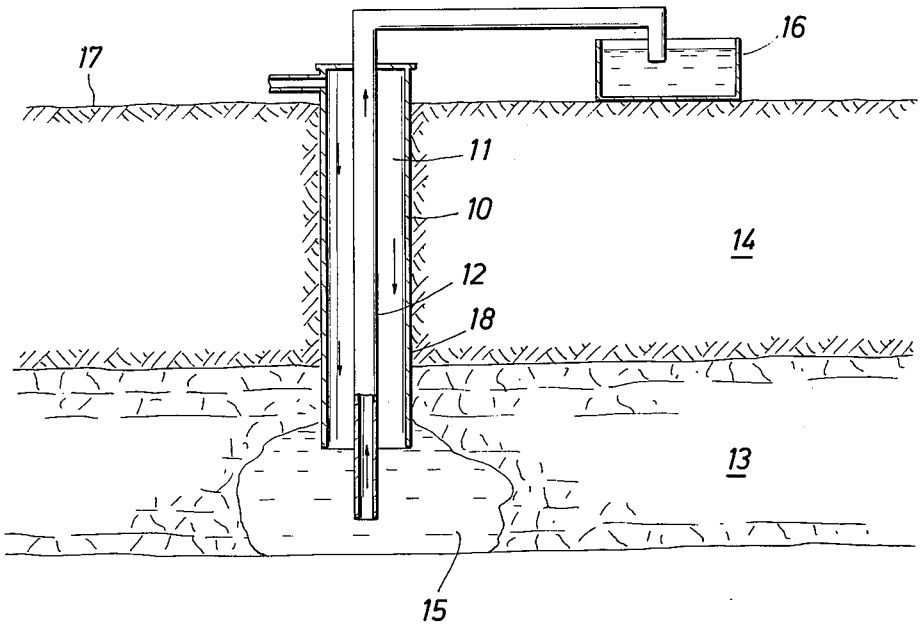
FIG. 1 is a simplified diagram of the cross section of a single borehole communicating between the surface of the earth and a coal seam.

In its broadest aspect, it can be seen that the process of the instant invention is a process for the treatment of coal to disintegrate the coal seam. Coal generally refers to the commonly known substance which is a solid, brittle, more or less distinctly stratified, combustible carbonaceous rock, which has been formed by partial-to-complete decomposition of vegetation over a period of many years, and varies in color from dark brown to black. Coal is entirely different from oil shale or tar sand. The coal is generally not fusible without decomposition, and has limited solubility in most solvents. The types of coal which can be treated, using the process of this invention, include lignite, sub-bituminous, bituminous of various classifications, i.e., low, medium, and high rank bituminous; semi-bituminous coal, semi-anthracite, anthracite, and super-anthracite coal. Generally it is found that the process is particularly useful for sub-bituminous coal, especially those deposits found in Western United States, such as in the Big Horn Mine, Wyoming.

While it is not completely understood why contacting with basic aqueous solutions such as caustic solutions causes coal to substantially disintegrate, and it is not desired to be bound by any particular theory, it is thought that the primary cause of the reaction is the selective dissolution of certain natural components of coal. That is, certain portions of the coal, which have been formed from the vegetable matter, are more subject to attack by the basic solution than others. The basic solution attacks at these positions, thus forming channels within the coal, ultimately weakening the binding and the adhesion between the coal constitutents, and causing the coal to fall apart. It appears, from photomicrographs, that deep channels corresponding to the reactive materials are left after treatment by the basic solution according to the process of this invention. Thus, in an underground coal seam formation of these microscopic channels and the resultant weakening of coal structure causes disintegration of the coal. Eventually the coal is disintegrated to a particle size which is small enough to form a slurry.

The basic aqueous solution contemplated for use in the process of the invention is a water solution of a basic substance, i.e., a substance which, when added to water, will increase the hydroxide ion concentration of the water. Generally, this includes many oxides and hydroxides such as those of the alkaline metals, i.e., sodium, lithium, potassium, and the like. Of these sodium hydroxide is particularly preferred. Also useful as a basic aqueous solution is a water-solution of ammonia, i.e., ammonium hydroxide. Other basic aqueous solutions such as alkaline carbonates or bicarbonates, e.g., sodium carbonate and sodium bicarbonate, may also be used in the process of this invention, but with a lesser degree of effectiveness. The solutions useful in the process of this invention vary in strength from a lower range of about 0.1 percent by weight (% *w*) of the basic substance, and preferably about 1.0 % *w*, to an upper range of about 25% *w*, preferably about 10% *w*, depending on solubilities of the basic substance. It appears that generally the amount of basic substance needed to effectively treat the coal will range from about a lower limit of 0.1 part to about 0.4 parts by weight of the basic substance per part by weight of coal, and not much advantage is gained by exceeding about 0.25 parts base per part coal.

Generally, it is found that the effectiveness of the treatment of coal increases with increasing temperature, that is, the coal disintegrates more completely (forms smaller particles) in a given time period as the temperature increases. Thus, the temperature range over which the coal can be treated with the basic aqueous solution extends substantially over a range of temperatures from just above the freezing point of the solution to somewhere near the solution's boiling point. For the pressures envisioned, this temperature range is approximately 50° F to about 650° F, preferably about 50° F to about 212° F.

The length of time which the basic aqueous solution must be held in contact with the coal appears to depend, i.a., upon the type of coal, as well as the strength of the basic solution. Generally, the more concentrated the base is, the faster the reaction will be, and generally the process is most effective on sub-bituminous and bituminous type coals. Generally, at the base/coal ratios given above, it is found that the contact time will be less than 24 hours and preferably less than 12 hours but more than 30 minutes.

The pressure at which the reaction is carried out can be atmospheric, sub-atmospheric, or super-atmospheric. However it is preferred to use a pressure which is atmospheric or above. This will generally be from about 1–100 atmospheres.

The gaseous environment in which the coal is treated may be inert or reactive, but is preferably inert, i.e., an environment which does not substantially react with the coal, such as nitrogen or methane. In the usual situation, i.e., in an underground coal formation, the natural atmosphere is generally inert, but if it is not, nitrogen may be pumped into the formation along with the basic aqueous solution to provide an inert environment.

If the environment in which the coal is contacted by the basic aqueous solution is reactive that is the coal is in contact with an oxygen containing substance below the combustion point, the rate of disintegration appears to be decreased in some cases, but there is an improvement in the recovery of chemical values from the aqueous solution after contacting the coal. Thus another aspect of this invention involves contacting coal with a reactive oxygen-containing substance, contacting the coal with the basic solution, then recovering chemical values from the solution after contacting the coal. Of course, chemical values can also be recovered from the aqueous solution after contacting the coal in an inert environment as well.

The coal may be contacted with the oxygen-containing substance before contacting with the basic aqueous solution, simultaneously therewith, or both. The oxygen-containing substance may be a free-oxygen containing fluid such as air or oxygen itself or may be an oxidizing agent such as nitric acid, hydrogen peroxide, nitrates, chlorates, perchlorates, permanganates, organic peroxides, and the like. The coal may be contacted by these oxidizing agents alone, in concentrated solution, or in dilute solution. Generally, because of availability, air and oxygen are preferred. Although the mechanism of reaction is not completely clear, it is thought that active acid centers on the coal surface are first oxidized which in turn makes these centers more susceptible to attack by the basic aqueous solution. It appears that this improved reactivity at these centers slows down the action of the disaggregation process but improves the recovery of chemical values from the basic aqueous solution after contacting the oxidized coal. In keeping with the invention, the process can be seen as alternatingly contacting the coal with the oxygen-containing substance and the basic aqueous solution. Chemical values, principally organic in nature, are recovered from the aqueous solution by any of the methods known in the art, such as extraction using organic solvents or adjustment of the pH of the aqueous phase. Chemical values recovered include humic acids which are valuable as plant fertilizer.

Although, as pointed out above, the process of this invention comprises treating a coal bed that is below the surface of the ground by contacting with a basic aqueous solution, if the basic aqueous solution is used to treat a bed of coal that outcrops at the surface of the earth, i.e., an open pit mine, coal can be disaggregated completely by treatment with the basic aqueous solution and is therefore more readily scooped out using mechanical means such as shovels, draglines, etc. Similarly, the structural integrity of an underground coal formation may be decreased and the coal can thus be more readily mined using mechanical methods, or using hydraulic pressure.

The coal can be contacted in any of the methods known in the art. For instance, if the coal is in an open pit mine, the basic aqueous solution can merely be poured or pumped to the exposed surface of the coal and allowed to contact the coal until it disaggregates sufficiently to be handled by other means, i.e., scooped or slurried out. The disaggregation can be speeded up by circulating the basic aqueous solution over the surface of the coal. It is also foreseen that basic aqueous solution could be sprayed onto the coal at pressures sufficient merely to wet the surface of the coal or at hydraulic pressures sufficient to assist in the disaggregation of the coal by the pressure itself.

Reference is made in the following discussion to FIG. 1 for the purposes of further explaining the process of this invention but not in a limiting manner. Where the coal lies beneath the earth's surface 17, it is preferred to carry out the process of this invention by penetrating the overburden 14 and the coal seam 13 so that communication is established between the surface and the coal seam. The penetration of the coal bed is generally done by any known methods of drilling and establishing a borehole 10 communicating between the earth's surface 17 and the coal formation 13 underground. When communication has been established, the basic aqueous solution is passed through the borehole 10 and into contact with the coal bed 13. This can be done merely by pumping the basic aqueous solution through the well borehole so that the solution contacts the coal at the lower end of the borehole. To increase initial contact a cavern 15 may be formed by explosive means, hydraulic pressure, or mechanical means known in the art around the underground end of the well borehole, so that more surface area of the coal is exposed to the basic aqueous solution when it is pumped down. In order to increase the contact of the basic aqueous solution with the surface of the coal even more, the formation may be fractured by any of the conventional methods known in the art, such as hydrofracting, explosive means, nuclear means, etc. Further, if the coal is associated with water-soluble minerals, these minerals can first be dissolved out by passing water through the borehole into contact with the water soluble minerals, and withdrawing the solution of water-soluble minerals in the water. Thereafter, the basic aqueous solution can be pumped down the borehole to contact the exposed coal surfaces. If the water soluble minerals are base-forming, the basic solution formed by injecting water may be left in contact with the coal for a time sufficient to disaggregate it.

The process of the invention may be carried out by installing a tubing string 12 down the center of borehole 10. The basic aqueous solution is pumped down the annular opening 11 into contact with the coal, then the solution (which has already contacted the coal) is pumped out of contact through tubing string 12 to the receiving terminal 16. The roles of tubing and the annular opening may be reversed.

Figure 2:
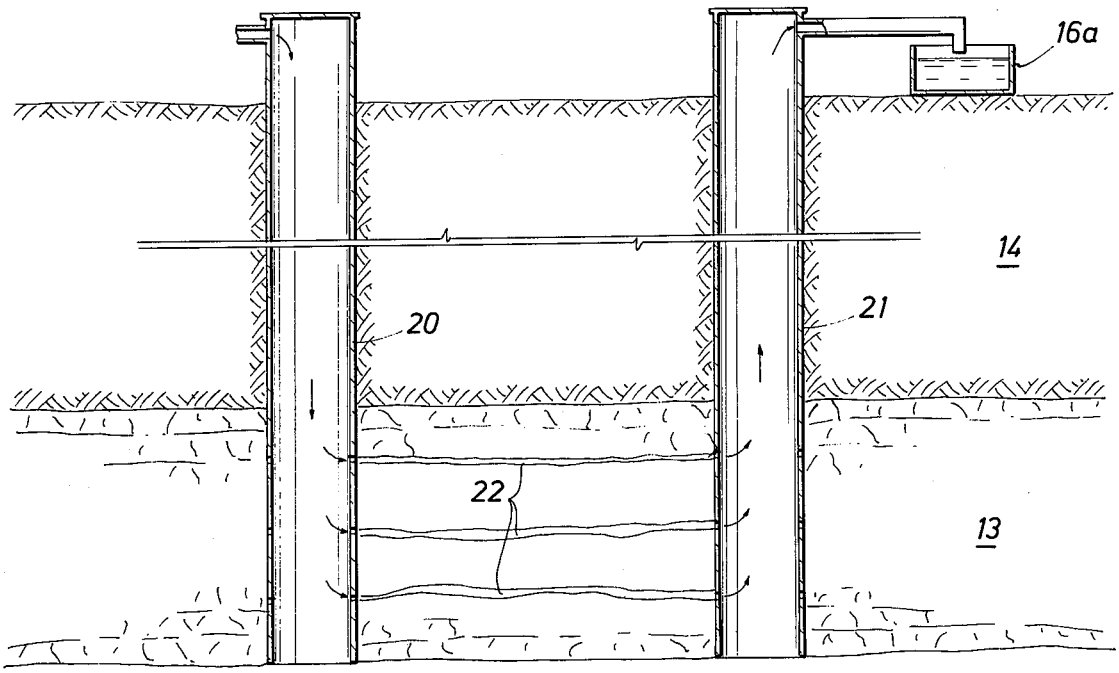
FIG. 2 shows a cross section of a formation penetrated by at least two wellbores.

In some cases it is preferable to penetrate the coal formation with at least two boreholes, as shown in FIG. 2—one an injection well 20 and the other a production well 21, then fracturing the formation, using conventional means mentioned before, or otherwise creating permeable connections between wells such as drilling or mining, to establish communication between the two wells, and pumping the basic aqueous solution down the injection well into contact with the coal formation, through the fractures 22 to the production well, and out the production well. The basic solution is maintained in contact with the coal for a sufficient time to disaggregate the coal and form a zone of coal of increased permeability. In some cases, it is preferable to penetrate the formation with more than one injection well and more than one production well surrounding the injection wells, establishing communication between the injection wells and the production wells, passing the basic solution through the injection wells to the formation and out through the various production wells. This can be done using generally any type of well configuration taught in the prior art such as 5, 7, 9 and 13 spot patterns. The basic solution which has contacted the coal is then reused or is treated to recover the organic material which may be dissolved or suspended therein.

According to one aspect of this invention, after communication is established between the surface and the coal seam using one of the techniques described above the coal is contacted with the basic aqueous solution for a period of time sufficient to disintegrate the coal and form a slurry which is then transferred out a tubing string 12 (FIG. 1) or a production well 21 (FIG. 2) to a receiving terminal 16 or **16*a*** for further treatment. Generally a slurry is formed using the basic aqueous solution alone, but other substances may be added to increase the ease with which the slurry is formed. These additives include such things as neutral salts to increase the density of the basic aqueous solution to increase the ease of suspension of the disaggregated coal particles, e.g. $Na_2CO_3$, $CaCl_2$, $BaCl_3$; polymers to thicken the water and thus improve the degree of suspendability of the particles, e.g. guar gum, polyacrylamide; and foaming agents such as anionic, cationic or nonionic foam forming surfactants, particularly anionic agents such as sodium dodecyl benzene sulfonates, as disclosed in U.S. Pat. Nos. 3,463,231 and 3,707,193 to Smith et al. Particularly suitable surfactants comprise mixtures of alkali metal salts of petroleum sulfonates and sulfated polyoxyalkylated alcohol surfactants, such as the mixtures described in U.S. Pat. No. 3,508,612 to Reisberg, Smith and Lawson. Suitable sulfonate surfactants are commercially available as Petroleum Sulfonates from Bray Chemical Company, Bryton Sulfonates from Bryton Chemical Company, Petronates and Pyronates from Sonneborn Division of Witco Chemical Company, Promor Sulfonates from Mobile Oil Company, and the like. Surfactant sulfates of ethoxylated alcohols are available as Neodols from Shell Chemical Company, Tergitols from Union Carbide and the like. Suitable soap type surfactants include sodium oleates, the soaps of tall oils, etc., such as those commercially available as Acintol Heads from Arizona Chemical Company, etc. Cationic surfactants such as quaternary ammonium salts (e.g., Redicots E-11 from Armour Chemical Company) and the like surfactants can also be used. The slurry can then be lifted to the surface by using mechanical means such as buckets and screws, pumps, etc. Once the coal is disintegrated sufficiently, it may be swept from the formation by a stream of water or other slurrying fluid. The water may contain any of the above mentioned agents which tend to increase the ease with which a slurry of the disintegrated coal is formed.

It appears that the basic material is absorbed into the coal or reacts with coal in such a manner that alkaline metal, e.g., sodium is retained on the coal in some manner. For this reason, it is preferable to attempt to recover the alkaline metal value from the coal at or near the point at which the coal slurry is taken from the ground. This may be done by treating the coal to extract the alkaline metal values prior to extracting energy values from the coal, or the coal may be first used to recover energy values and thereafter the alkaline metal may be recovered, e.g. from the remaining ash after burning the coal to obtain heat values.

If, instead of directly slurry mining, it is desired to recover heating values from the coal in situ, after the coal has been made permeable, it is further treated by various methods generally known in the art to gasify, or liquify the coal, depending upon the desired product. Of these processes, gasification is probably in the most advanced stage of development. Generally the gasification comprises contacting the treated coal bed first with a head-carrying fluid, i.e., a liquid or gas which by means of thermal, chemical or solvent action or any combination thereof interacts with the coal to produce or entrain combustible gases, such as carbon moxoxide, hydrogen or methane and other hydrocarbons. Such fluids include steam, air, oxygen, hydrocarbons, hydrogen, carbon dioxide, or mixtures thereof. There are two main approaches to gasification:

1. One is to gasify by forcing hydrogen into the treated coal seam at high temperatures and pressures to form hydrocarbons
2. The second approach is to partially oxidize the carbon content of the coal formation to form carbon oxides and heat. Steam present can then be used and can react to yield hydrogen and additional carbon oxides. The carbon monoxide from both steps can react with steam to yield still more hydrogen and $CO_2$. Hydrogen can be used for methanation and gas upgrading. In the second, preferred approach the coal is gasified, using an in-situ combustion process wherein a combustion front is initiated and sustained between two or more boreholes by injecting a combustion supporting fluid into the treated coal formation at temperatures sufficient to establish combustion and pressures sufficient to move the combustion front from one borehole to the other. Preferably the combustion supporting fluid is an oxygen containing-fluid which oxidizes the coal and generally either contains free oxygen or decomposes to form free oxygen. The free oxygen supports underground combustion. Such oxygen containing fluids include air, oxygen, hydrogen peroxide, nitrates such as sodium or potassium nitrates, perchlorates, permanganates and the like. Preferably the oxygen containing fluid injected into contact with the permeabilized coal formation is air or oxygen itself. The temperature at which combustion takes place is about 400° C to about 1200° C and preferably, more than about 600° C. Combustion can be initiated by any known means, e.g., an electric down hole heater can be used to ignite the coal in the presence of oxygen or an oxygen/fuel mixture can be injected and ignited to initiate combustion of the coal in the permeabilized coal formation. The pressure at which the oxygen containing fluid is injected into the permeabilized coal formation is above formation pressure and sufficient to force a combustion front through the formation from the injection borehole to the production borehole. This pressure is generally greater than 100 pounds per square inch (psi) and may be up to 7500 psi, or a value not exceeding the formation-fracturing pressure. Generally the pressure will be less than 1000 psi.

Processes for in-situ gasification include those described in U.S. Pat. Nos. 3,946,382 to Tek; 2,967,082 to Crawford; 3,048,225 to Reichle; 3,072,186 to Parker; 3,298,434 to Graham; 3,395,756 to Lange et al; 3,734,180 to Rhoades and 3,734,184 to Scott and as much of those patents as is pertinent is incorporated by reference herein.

Alternatively, the underground permeabilized coal formation may be liquified by an in situ inert pyrolysis or hydrogenation, or may be devolatized. Inert pyrolysis is carried out by adding heat to the formation in the absence of oxygen. In a formation treated by the process of this invention which is penetrated by at least one borehole, and preferably two or more, a heating means, e.g. an electric heating device is placed in the permeabilized area and the formation is heated sufficiently to cause distillation. The treated formation can be devolatized (i.e. volatile material associated with the coal driven off) by passing a heat-carrying fluid e.g., $CO_2$, steam, $CH_4$ or $N_2$, into contact with the coal formation previously disaggregated by treatment with the basic aqueous solution. Another aspect of the process is to contact the permeabilized coal formation with an organic solvent, such as an anthracene rich coal tar fraction, in a hydrogen atmosphere at high temperature, i.e. above 400° C. U.S. Pat. No. 3,010,077 to Craighead and Purre described another liquification process using steam and as much of that patent as is pertinent here is incorporated by reference.

This invention will be further explained in detail with reference to the following embodiments which are given in way of illustration only and not by way of limitation.

EMBODIMENT I

Several pounds of coal (analysis shown in Table 1) were washed and stored over water at room temperature for several days prior to sampling. The plastic containers used for this purpose were filled with coal then sealed to exclude as much air as possible.

The largest pieces of coal available were selected to make up a sample of 100 grams. The pieces ranged from roughly 1 inch to 1¾ inches in their major dimension and all were easily retainable on a 10 hole/inch sieve. The sample was weighed into a five inch diameter crystalizing dish and covered with 200 ml of solution containing about 5 grams NaOH. The coal samples remained in contact with the dilute caustic for four hours at room temperature while sparging with nitrogen in one case and oxygen in another. The solutions covering the coal samples were kept in motion with a magnetic stirrer.

At the end of the four hour extraction period, the liquid fraction was decanted, the extracted coal was washed with distilled water and the washings combined with the decanted aqueous extracts. To remove suspended matter, each extract with combined washings was centrifuged and filtered through ½ micron millipore filters. Supernatant solutions were diluted to 500 ml. Total coal solids undissolved in the extractions were dried in-vacuo at 50° C, weighed and size fractionated. The distribution of various sieve size fractions are shown in Table 2. The coal was completely disintegrated, i.e., none of the coal pieces retained their original size, in both the nitrogen and oxygen sparged runs, but the coal was not disintegrated to as great an extent in the case where oxygen was sparged as in the case of nitrogen. However, a greater portion of coal sample was recovered as dissolved chemical values in the run which was sparged with oxygen.

Table 1

| Proximate Analysis (Moisture Free) | | Ultimate Analysis (Moisture Free) | |
|---|---|---|---|
| Ash | 5.86 | Carbon | 69.90% |
| Volatiles | 42.86 | Hydrogen | 5.14% |
| Fixed Carbon | 51.28 | Nitrogen | 1.61% |
| Btu/lb | 12,125 | Chlorine | 0.09% |
| | | Sulfur | 0.52% |
| | | Ash | 5.86% |
| | | Oxygen (diff) | 16.88% |

Table 2

PARTICLE SIZE DISTRIBUTION FOR COAL SAMPLE (*) EXTRACTED WITH DILUTE CAUSTIC

| Sparging Fluid | Fraction of Sample Remaining As Solids** | Sieve Analysis, U. S. Standard Mesh | | | | | | |
|---|---|---|---|---|---|---|---|---|
| | | On 10 % | 10–20 % | 30–30 % | 30–60 % | 60–120 % | 120–325 % | 325–Pan % |
| Oxygen | 93.17 | 71.54 | 18.57 | 4.52 | 4.02 | 0.80 | 0.47 | 0.08 |
| Nitrogen | 95.95 | 28.30 | 27.74 | 15.14 | 23.15 | 3.10 | 0.85 | 1.72 |

*100 gram coal samples (reference state 100 percent relative humidity) extracted with 200 ml .6 M NaOH.
**Weight basis of both products and original sample is that in equilibrium with 100 percent relative humidity.

EMBODIMENT II

Figure 3:
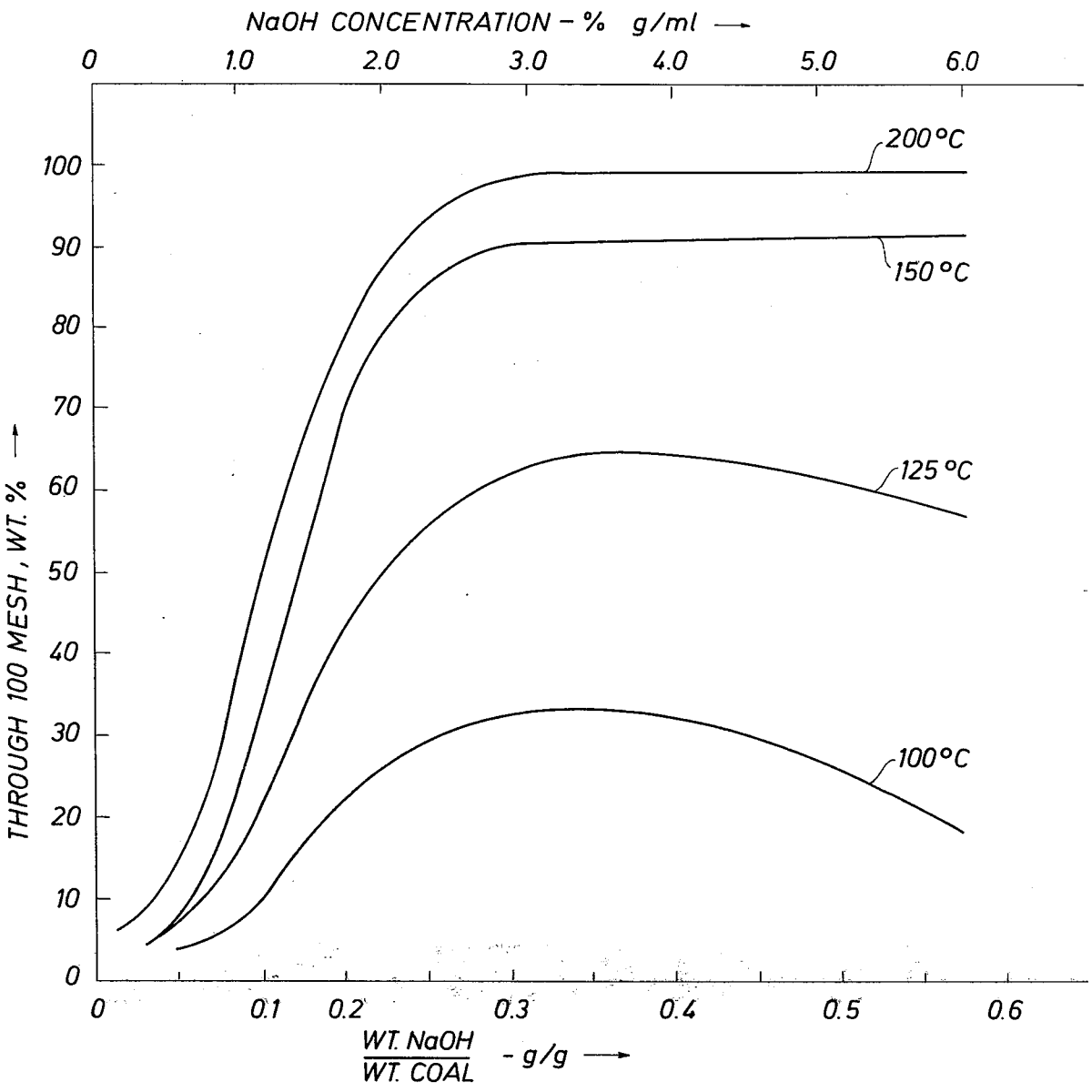
FIG. 3 is a plot showing the relationship between degree of disintegration of the coal, NaOH concentration, and NaOH/coal ratio.

A series of experiments was performed on the same coal as used in Embodiment I to assess the effects of base concentration and temperature on the degree of coal disintegration. Each seventy-five gram sample of pea-sized (3–5 mm) coal was placed in a one-liter sealed reactor together with 650 ml sodium hydroxide solution varying in concentration from 0 to 6 percent. Each sample was heated at one of four specific temperatures ranging from 100° C to 200° C for a period of 24 hours. The treated coal was then removed from the reactors, washed and finally dried in vacuo at 105° C. Sieve analyses of the dry sample gave the particle size distribution shown in Table 3. FIG. 3 is a plot showing the weight fraction of coal small enough to pass 100 mesh after treatment with sodium hydroxide at the various concentrations and temperatures.

From the data obtained it appears that for the specific temperatures at which the coal alkali reactions were investigated, the degree of disintegration and hence the amount of coal reacting is concentration dependent over a limited range only. Data in FIG. 3 show the strong dependence on temperature and also show that beyond 0.25 gram NaOH per gram of coal there is no increase in the amount of coal disintegrated to the point that it will push through a 100 mesh sieve.

Table 3

RESULTS FROM 24 HR: (ONE DAY) COAL DISAGGREGATION RUNS

| Exp. No. | Temp. °C | Wt. Coal | Wt. NaOH / Wt. Coal g/g | Solution wt % NaOH | Sieve Analysis (U.S. Standard Sieve) On 4 % | 4–6 % | 6–8 % | 8–18 % | 18–20 % | 20–100 % | 100–Pan % |
|---|---|---|---|---|---|---|---|---|---|---|---|
| Original Coal | — | — | — | — | 70 | 28 | 1.5 | 0.5 | 0 | 0 | 0 |
| A-1 | 100 | 75 | 0.065 | 0.75 | 25 | 21 | 12 | 27 | 3 | 7 | 5 |
| A-2 | 100 | 75 | 0.130 | 1.5 | 12 | 10 | 10 | 33 | 4 | 12 | 18 |
| A-3 | 100 | 75 | 0.260 | 3 | 3 | 9 | 10 | 27 | 4 | 14 | 33 |
| A-4 | 100 | 75 | 0.520 | 6 | 4 | 13 | 12 | 34 | 4 | 13 | 19 |
| B-1 | 125 | 75 | 0.130 | 1.5 | 7 | 10 | 9 | 21 | 3 | 11 | 39 |
| B-2 | 125 | 75 | 0.173 | 2 | 4 | 9 | 9 | 17 | 2 | 10 | 49 |
| B-3 | 125 | 75 | 0.260 | 3 | 0 | 4 | 6 | 18 | ½ | 9 | 63 |
| B-4 | 125 | 75 | 0.520 | 6 | 1 | 3 | 4 | 18 | 3 | 14 | 57 |
| C-1 | 150 | 75 | 0 | $H_2O$ Only | 62 | 31 | 2 | 1 | 0 | 0 | 3 |
| C-2 | 150 | 75 | 0.032 | 0.38 | 37 | 38 | 10 | 7 | 1 | 2 | 5 |
| C-3 | 150 | 75 | 0.065 | 0.75 | 22 | 17 | 11 | 22 | 3 | 10 | 15 |
| C-4 | 150 | 75 | 0.130 | 1.5 | 12 | 11 | 6 | 11 | 1 | 4 | 54 |
| C-5 | 150 | 75 | 0.173 | 2 | 3 | 7 | 5 | 10 | 2 | 6 | 67 |
| C-6 | 150 | 75 | 0.260 | 3 | 0 | 1 | 2 | 5 | 0 | 2 | 91 |
| C-7 | 150 | 75 | 0.520 | 6 | 1 | 1 | 1 | 2 | 0 | 3 | 92 |
| D-1 | 200 | 75 | 0 | $H_2O$ Only | 66 | 26 | 2 | 1 | 0 | 0 | 5 |
| D-2 | 200 | 75 | 0.032 | 0.38 | 39 | 31 | 9 | 8 | 1 | 2 | 10 |
| D-2 | 200 | 75 | 0.065 | 0.75 | 22 | 17 | 13 | 23 | 2 | 5 | 19 |
| D-3 | 200 | 75 | 0.130 | 1.5 | 7 | 9 | 4 | 5 | 1 | 3 | 71 |
| D-4 | 200 | 75 | 0.260 | 3 | 0 | 0 | 0 | 0 | 0 | 1 | 99 |
| D-5 | 200 | 75 | 0.520 | 6 | 0 | 0 | 0 | 0 | 0 | 1 | 99 |

We claim as our invention:

1. A process for removing subterranean coal which comprises contacting said coal in situ with a basic aqueous solution and maintaining said contact for a time sufficient to completely disaggregate at least a portion of said coal, disintegrating said portion to form a slurry, and transporting said slurry to a receiving terminal.

2. The process of claim 1 wherein after said slurry is transported to said receiving terminal the liquid is separated from the solids and chemical values are recovered from said liquid and energy values are recovered from said solids.

3. The process of claim 1 wherein a substance is added to said basic aqueous solution to increase the ease of formation of said slurry.

4. The process of claim 3 wherein said substance is an anionic, cationic or nonionic surfactant.

5. A process for disaggregating coal located below the earth's surface and recovering chemical values therefrom which comprises contacting said coal with a reactive oxygen-containing substance, contacting said coal with a basic aqueous solution, and recovering chemical values from said aqueous solution after contacting said coal, said reactive oxygen-containing substance functioning to slow down disaggregation caused by said basic aqueous solution and improve recovery of chemical values.

6. A process of claim 5 wherein said oxygen-containing substance is a free-oxygen containing fluid and said fluid and said basic aqueous solution contact said coal simultaneously.

7. The process of claim 6 wherein said free-oxygen containing fluid is oxygen or air.

8. The process of claim 5 wherein said basic aqueous solution is aqueous sodium hydroxide.

9. The process of claim 5 wherein said basic aqueous solution is maintained in contact with said coal for a time sufficient to substantially disintegrate said coal and form a slurry, then said slurry is transported to a receiving terminal where the solids are separated from the liquid and chemical values are recovered from said liquid.

10. The process of claim 5 wherein said coal is located in a coal seam which is penetrated by at least one borehole through which said oxygen-containing substance and said basic aqueous solution are injected into contact with said coal.

11. The process of claim 10 wherein said coal seam is penetrated by at least two boreholes in fluid communication with each other, one of which is used to inject said oxygen-containing substance and said basic aqueous solution into contact with said coal while the other borehole is used to remove said basic aqueous solution from said formation after contact with said coal.

* * * * *